US012121145B2

(12) United States Patent
Fry

(10) Patent No.: US 12,121,145 B2
(45) Date of Patent: Oct. 22, 2024

(54) LIFT STORAGE SYSTEM

(71) Applicant: Kompak Trading Ltd., London (GB)

(72) Inventor: Joseph Fry, London (GB)

(73) Assignee: Kompak Trading Ltd. (GB)

( * ) Notice: Subject to any disclaimer, the term of this patent is extended or adjusted under 35 U.S.C. 154(b) by 163 days.

(21) Appl. No.: 17/868,799

(22) Filed: Jul. 20, 2022

(65) Prior Publication Data

US 2023/0027599 A1 Jan. 26, 2023

Related U.S. Application Data

(60) Provisional application No. 63/224,013, filed on Jul. 21, 2021.

(51) Int. Cl.
*A47B 46/00* (2006.01)
*A47C 19/22* (2006.01)

(52) U.S. Cl.
CPC ..... *A47B 46/005* (2013.01); *A47C 19/22* (2013.01); *A47B 2220/01* (2013.01)

(58) Field of Classification Search
CPC ..... A47C 19/22; A47C 17/86; A47C 19/045; A47B 2220/01; A47B 46/005; A47B 49/002
See application file for complete search history.

(56) References Cited

U.S. PATENT DOCUMENTS 5,020,173 A * 6/1991 Dreyer, Jr. ..... A47C 17/86 297/188.1
9,049,940 B1 6/2015 Youngstrom
(Continued)

FOREIGN PATENT DOCUMENTS

CN 201312661 Y * 9/2009 ..... A47C 19/045
ES 2442441 A1 2/2014
(Continued)

OTHER PUBLICATIONS

IT-201900018497-A1 ENG (Year: 2021).*
CN-201312661-Y ENG (Year: 2009).*

*Primary Examiner* — Eric J Kurilla
*Assistant Examiner* — Amanda L Bailey
(74) *Attorney, Agent, or Firm* — Jose Cherson Weissbrot

(57) ABSTRACT

A combined storage system comprising: a first frame having a width, length and height which defines an internal volume space, and guide rails located along the lower width of the bedframe; a support frame fitting within the length and width of the first frame and being pivotally connected thereto, movable between a closed position wherein the support frame is parallel with the plane defined by the upper width and length of the first frame, and an open position wherein the support frame and said defined plane have an acute angle therebetween; a primary storage unit pivotally connected to the support frame and occupying a first position, within the internal volume when in the closed position; a secondary storage unit pivotally connected to the support frame and slidably engaged with the guide raids and occupying a second position within the internal volume when in the closed position; wherein when the support frame is pivoted from, the closed to the open position, the primary storage unit raises with the support frame and occupies a space between the support frame and the first frame, and the secondary storage unit slides along the, guide rails from the second position into the first position.

9 Claims, 3 Drawing Sheets

(56) References Cited

U.S. PATENT DOCUMENTS

| | | | | |
|---|---|---|---|---|
| 2018/0220803 | A1* | 8/2018 | Blueford | G08B 25/10 |
| 2019/0082853 | A1* | 3/2019 | Hurdel | A47C 17/46 |

FOREIGN PATENT DOCUMENTS

| | | | | |
|---|---|---|---|---|
| IT | 201900018497 | A1 * | 4/2021 | A47C 23/06 |
| WO | 2016111908 | A1 | 7/2016 | |

* cited by examiner

LIFT STORAGE SYSTEM

The present invention relates to optimising space utilisation. Specifically, the present invention, relates to underbed space optimisation for storage. More specifically, the present invention relates to an ottoman style bed with optimised storage solutions. Even more specifically the present invention relates to an ottoman style bed with a mechanical access system providing easy access to the full bed footprint space from one side via automated underbed self levelling shelves/containers.

BACKGROUND OF THE INVENTION

The Ottoman bed, is known (ES2442441A1) and has existed for some time. It allows basic access to a storage area beneath the mattress of a bed, however it has considerable limitations in accessibility in small spaces and requires the user to possess a large range of movement that is not suitable or even possible for all potential users.

Storage beds with drawers are also known (U.S. Pat. No. 9,049,940B1) with common names such as the Captains Bed, Divans, Storage beds. All these units provide alternatives to the Ottoman but require free space around the bedstead to extend drawers into which is often not available as modern trends are to larger beds but smaller living spaces. They also like the ottoman require the user a level of physical flexibility that is not always possible.

None of the above storage systems allow effortless access for the user, nor do they provide mechanical movement to optimize the storage space and access to this.

Beds with external self-levelling shelving are known (WO2016111908A1). This provides a limited shelf which is incorporated into the beds stability system in the form of the supporting external legs of the bed, at all times this shelf is visible and usable in both open and closed positions. However, this storage is severely limited in its actual storage capability, and is more ornamental than functional as a shelf. Rather it becomes a means to provide additional purpose to the bed's legs when in the upward/closed position. This bed does not offer an extensive storage area and is only applicable to wall/folding beds which are a different class of bed than a traditional/Ottoman style of bed.

There does not currently exist a bed which combines both the storage capacity of the Ottoman with the ease of use or incorporation into function of the Self-Levelling Shelf Bed.

It is an object of the present invention to combine these two areas while providing an innovative solution to linking them with the minimum user effort/interaction. Specifically it the invention provides a bed with a storage system situated within its 'Base'/Main bedframe. This storage system can include a primary, or primary and secondary storage system and is mechanically operated by the user with minimum effort via a gas assisted system incorporated into the bedframe. The primary storage system will move via this mechanical system to move from its storage position within the base to lift to be level with or above the upper edge of the bedframe to allow ease of access for the user. The primary storage system moving from an underbed position along a diagonal axis to an alternate height for user interaction and returning thusly when the primary storage system is returned to its original position.

The primary and secondary storage system operates similarly to the primary storage system on its own. However, it also includes a secondary storage area within which a secondary set of shelving is situated on runners interconnected with the primary opening mechanism and moves horizontally to access its position with the two storage systems acting in unison or in a staged approach but still linked and operated combined with the user interaction remaining the same with the primary or primary and secondary storage systems.

This invention is advantageous as it significantly improves on the accessibility of bedstead storage. The dual shelving system provides access to 80%,of the furniture's footprint. Ottoman bedsteads offer similar space utilisation without the accessibility.

Stored self-levelling shelving system within the main body of bedstead. This improves accessibility to the full storage area of the bed, with shelving bringing contents closer to the user. The self-levelling shelving systems allows users to store garments, soft goods or other goods requiring balanced movement.

The dual shelving system's significantly increase accessibility to the rear storage area of the bed. Typical storage beds, whether Ottoman (Gas assisted lift) or utilising drawers are difficult to access therefore losing considerable usable storage space.

The dual shelving systems open in sequence providing maximum accessibility to all storage areas. The primary shelving connected to the bedstead opens to an access position utilising ergonomics for the user's height.

The gas assisted lift mechanism can provide accessibility to the contents primarily through the top of the bed. For use in small spaces this is advantageous as floor space is restricted. Storage bed with drawers require floor space surrounding the bed to extend drawers, often both sides—with limited floor space this is not possible.

The stored shelving system can provide ventilation to stored items not possible in closed drawer storage. This can be a significant improvement for items like apparel where regular air circulation is required.

STATEMENT OF INVENTION

According to a first aspect of the invention there is provided a combined storage system comprising a first frame having a width, length and height which defines an internal volume space, and quid rails located along the lower width of the bedframe. A support frame fitting within the length and width of the first frame and being pivotally connected thereto, movable between a closed position wherein the support frame is parallel with the plane defined by the upper width and length of the first frame, and an open position wherein the support frame and said defined plane, have, an acute angle therebetween. A primary storage unit pivotally connected to the support frame and occupying a first position within the internal volume when in the closed position. A secondary-storage unit pivotally connected to the support frame and slidably engaged with the guide rails and occupying a second position within the internal volume when in the closed position. Wherein when the support frame is pivoted from the closed to the open position, the primary storage unit raises with the support frame and occupies a space between the support frame and the first frame, and the secondary storage unit slides along the guide rails from the second position into the first position.

An embodiment of the first aspect wherein the connection between the primary storage unit and the support frame is a self-levelling connection.

An embodiment of the first aspect wherein the primary storage unit it also pivotally connected to the first frame via a primary support rod.

An embodiment of the first aspect wherein the secondary storage unit is pivotally connected to the support frame via a secondary support rod.

An embodiment of the first aspect further comprising a telescopic lift aid, one end pivotally connected to the first frame, and the opposing end pivotally connected to the support frame. The telescopic lift aid may be a pneumatic piston. The telescopic lift aid may be a hydraulic piston.

An embodiment of the first aspect wherein the acute angle is between 40 and 80 degrees. The angle may be specifically 30 degrees.

An embodiment of the first aspect wherein the first frame is a bed frame and the support frame is for supporting a mattress.

An embodiment of the first aspect wherein the primary storage unit comprises multiple units that occupy the first position in the closed position but are staggered in height when in the open position

BRIEF DESCRIPTION OF THE DRAWINGS

The invention will be described in more detail, by way of example, with reference to the following drawings.

Figure 2:
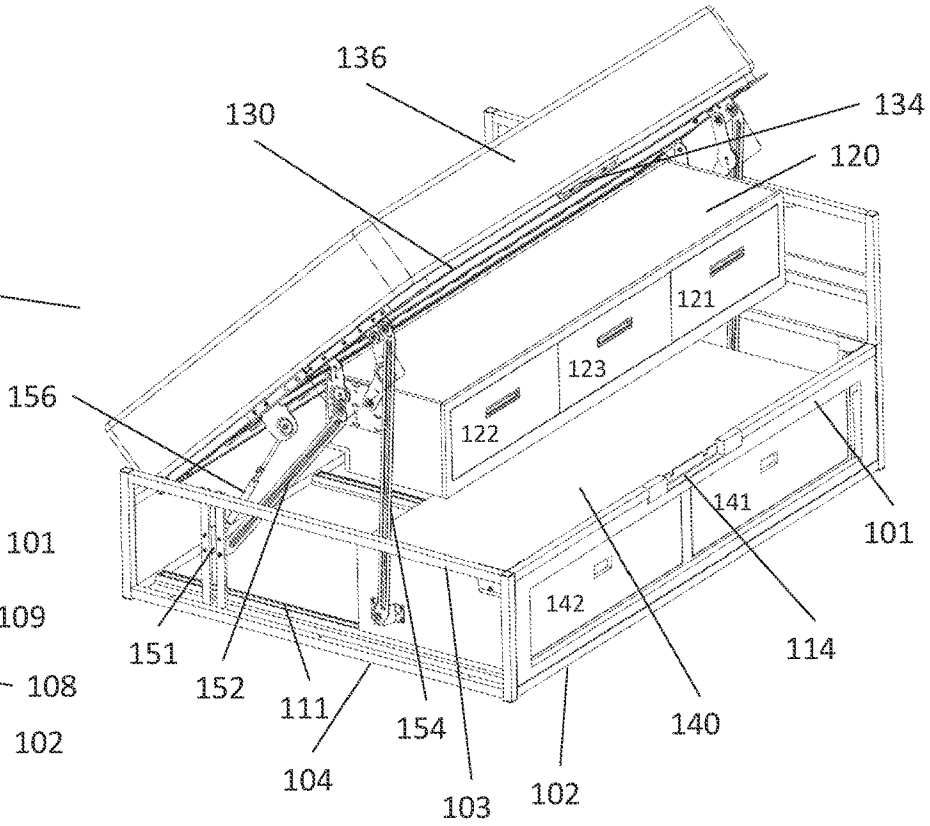
FIG. 2 depicts an embodiment of the invention in the open position with a mattress.

DETAILED DESCRIPTION with reference to FIGS. 1 to 5 a preferred embodiment of the invention will now be described. Lift storage bed 100 comprises a bed frame having a lower frame section footprint made from struts opposing width struts 104,108, each also having guide rails 111 situated on an inner surface, and length struts 102,106 connected in a rectangle; an upper frame section of the same footprint size having width struts 103, 107 and length struts 101,105. The lower and upper frame sections connected at the corners by 4 vertical struts 109. Encompassed by the upper frame section and parallel with the plane defined thereby (when in a storage/closed position) there is a mattress support frame 130, on which a mattress 136 rests when in use.

The mattress support frame is pivotally connected to upper frame width struts 103,107 at the corners 132 of the mattress support frame 130. Centrally located on a lengthwise edge distal to the corners 132 is a handle 134, which when in the closed position rests m notch 114 located in upper frame length strut 101. The handle 134 provides an easy-to-use grip for a user to hold when moving the lift storage bed 100 from a closed/storage position to an open/deployed position.

When in the closed position inside the volume defined by the bed frame and mattress support frame 130, there are primary and secondary storage units 120 and 140 respectively. Primary storage unit 120 in the closed position is situated proximal the length struts 101 and 102, it extends the majority of the full length of the inner volume of the bed frame, and extends substantially half of the width back into the internal volume. Primary storage unit 120 sits on top of guide rails 111 but is not attached thereto. Secondary storage unit 140 is of substantially the same size and is positioned "behind" the primary storage unit 120. Secondary storage unit 140 rests on guide rails 111 and is slidably engaged therewith.

On either end of primary storage unit 120 are attachment brackets 125, attached to each attachment bracket 125 are self-levelling mechanisms 153 and stabilising mechanisms 135 which are each attached to mattress support frame 130 at positions such that the primary storage solution 120 remains horizontal regardless of the angle of mattress support frame 130. Also pivotally attached to the ends of the primary storage unit 120 via bracket 125 at the same position as self-levelling mechanism 153 is one end of primary support rods 152, the other end being pivotally attached to additional support and securing sections 151 of the bed frame. Sections 151 connect upper and lower width beams 103,104 and 107,108 respectfully and are preferably positioned proximal but slightly spaced away from the corners formed with length beams 105 and 106. Self-levelling mechanisms 135 are in the form of a appropriately shaped cam in this embodiment, but any suitable mechanism known to a person skilled in the art can be used.

Self-levelling mechanisms 153, stabilising mechanisms 135, and primary support rods 152 attached to each end of primary storage unit 120 via brackets 125, and with mechanisms 153 and 135 being attached to mattress support frame 130. This arrangement allows for primary storage unit to be horizontal and stored within the bedframe when in the closed/stored position, when the mattress support frame 130 is parallel with and within the plane defined by the upper frame section. But also, when the frame 130 its lifted via handle 134 (or otherwise) and pivoted at pivot points 132, primary storage unit 120 raises with support frame 130 and maintains its, horizontal orientation throughout, such that any items stored within primary storage unit 120 are substantially undisturbed within primary storage unit 120.

On either end of secondary storage units 140, proximal an edge of unit 140 distal primary storage unit 120 when in the closed/storage position, are brackets 155. Pivotally connected to brackets 155 are one end of secondary support rods 154, the other end of secondary support rods 154 being pivotally connected to mattress support frame 130 at a location proximal to the connection points of stabilising mechanisms 135 to the, mattress support frame 130.

As mattress support frame 130 is pivoted upwards via handle 134 (or, otherwise), and primary storage unit 120 is lifted upwards, secondary storage unit 140 is urged by secondary support rod 154 to slide along guide rails 111 such that once in the fully open/deployed position secondary storage unit 140 occupies substantially the same position that primary storage unit 120 did in the closed/storage position.

Therefore with the present invention, when the mattress support frame is lifted via handle 134 (or otherwise) to the open/deployed position by a user, said user has easy access to the vast majority of the storage space of the bedframe without the need to stretch into the bedframe interior volume, nor does it require any additional floor space beyond footprint of the bedframe itself. To aid in the lifting of mattress support frame 130 and attached components, and to also aid in holding the mattress support frame 130 and attached components in the open/deployed position, is a telescopic gas support struts 156. One end of each strut 156 is attached to one of securing sections 151 respectively, the other end of each strut 156 being attached to mattress support frame 130. Instead of a telescopic gas strut, a gas or pneumatic piston may be used, or any suitable lift assisting system known by the skilled person can be used.

Figure 1:
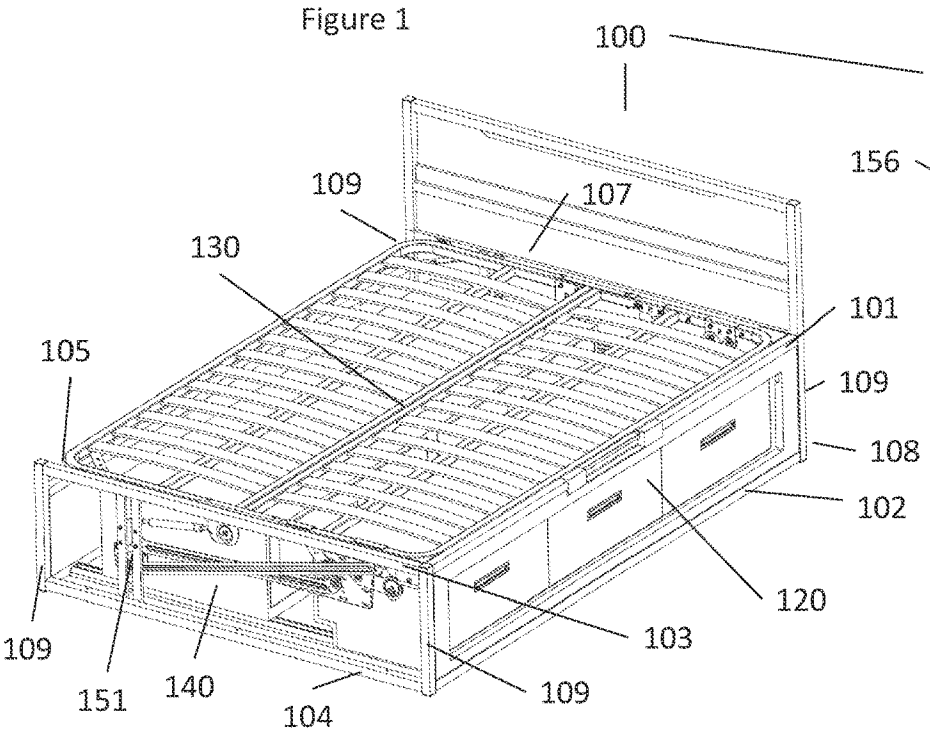
FIG. 1 depicts an embodiment of the invention in the storage position without a mattress.
Figure 3:
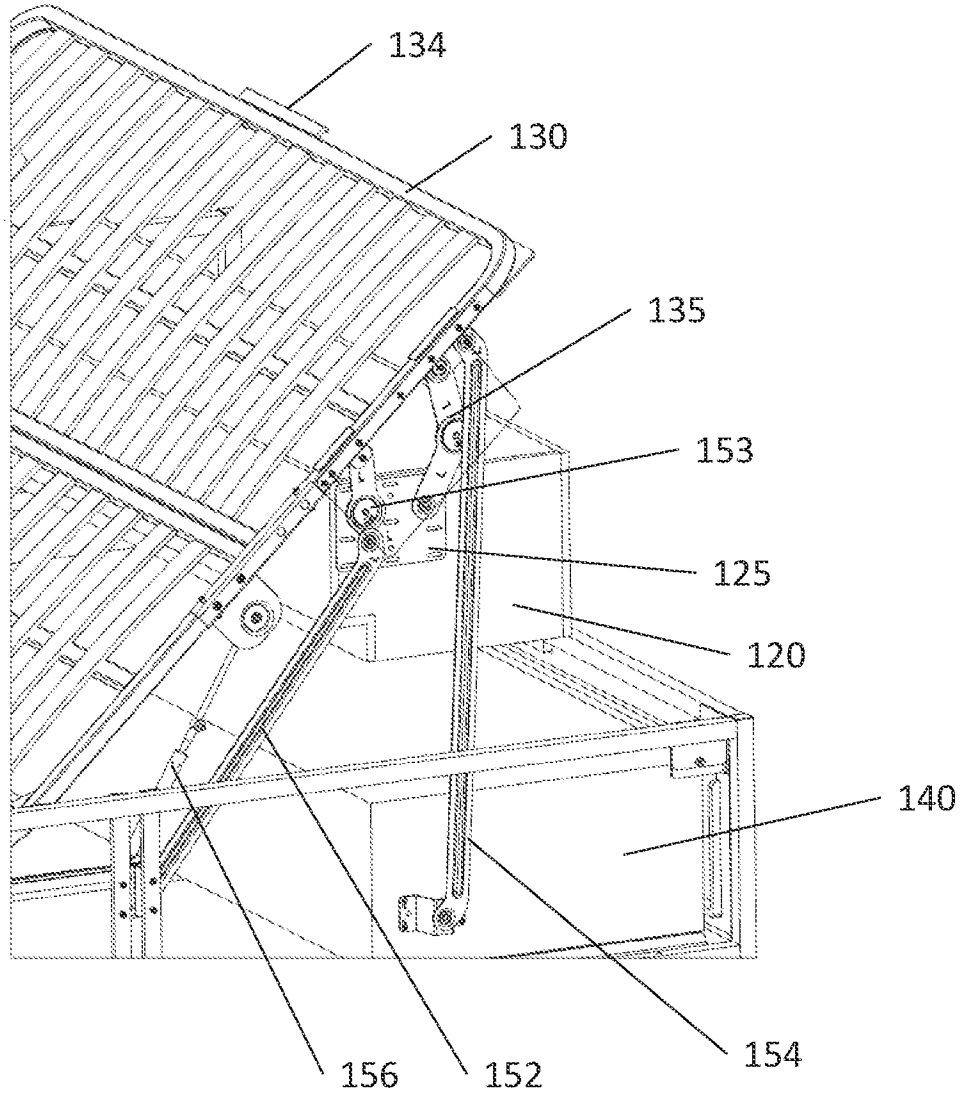
FIG. 3 depicts a close-up view of one side the self-levelling shelf of an embodiment of the invention.
Figure 5:
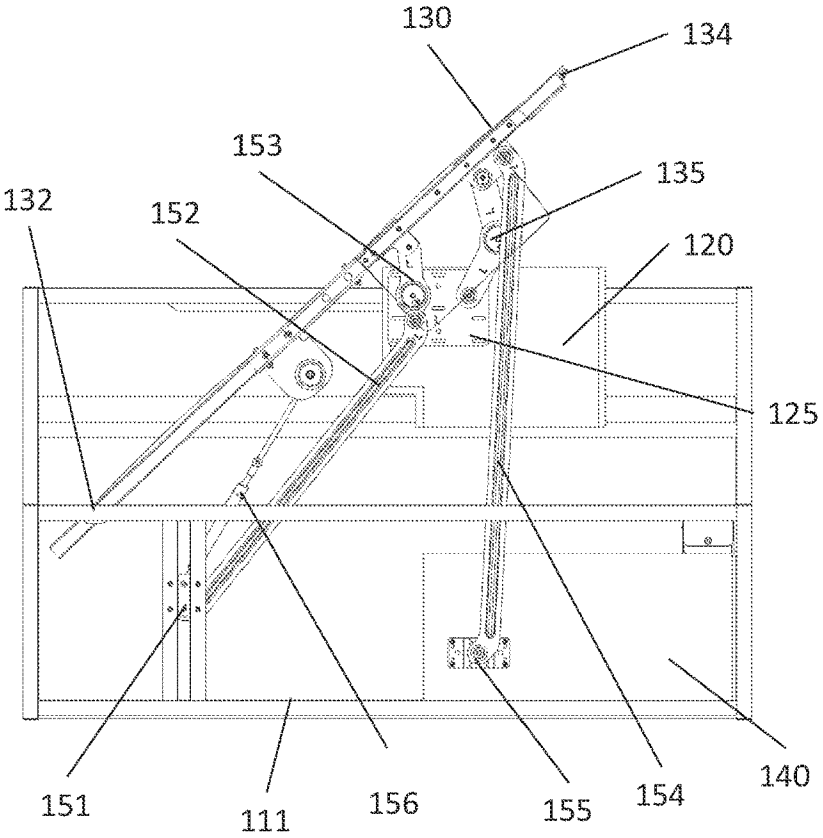
FIG. 5 depicts a side view of the actuating mechanism of an embodiment of the invention in the open position.
Figure 4:
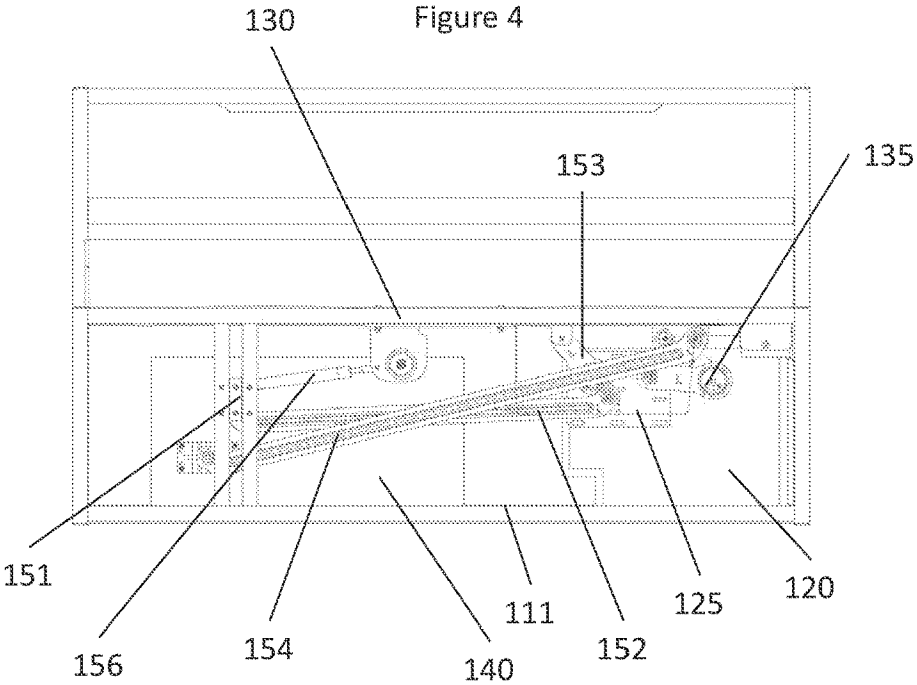
FIG. 4 depicts a side view of the actuating mechanism of an embodiment of the invention in a storage position.

In a preferred embodiment, best seen in FIGS. 1 and 2, primary and secondary storage units 120 and 140 both comprise draws (121,123,122,141,142). Also at least the side of the bed frame defined by upper and, lower length struts 101,102 and two of vertical struts 109 is open. Therefore while in, the closed/storage position the draws 121,123,122 of primary storage unit 120 are accessible by a user, providing access to the storage space without needing to raise the mattress support frame 130. And when in the open/deployed position the draws 141,142 of the secondary can be opened through the side of the bed frame defined by upper and lower length struts 101,102 and two of vertical struts 109, or via an open top of the secondary storage unit. Primary and secondary storage units 120 and 140 may optionally have open tops for ease of access when in the open position and providing better air circulation when in the closed position.

The invention has been described with reference to a preferred embodiment. The description is intended to enable a skilled person to make the invention, not to limit the scope of the invention. The scope of the invention is determined by the claims.

The invention claimed is:

1. A combined storage system comprising: a first frame having a width, length and height which defines an internal volume space, and guide rails located along the lower width of the bedframe; a support frame fitting within the length and width of the first frame and being pivotally connected thereto, movable between a closed position wherein the support frame is parallel with the plane defined by the upper width and length of the first frame, and an open position wherein the support frame and said defined plane have an acute angle there between; a primary storage unit pivotally connected to the support frame and occupying a first position within the internal volume when in the closed position; a secondary storage unit pivotally connected to the support frame and slidably engaged with the guide rails and occupying a second position within the internal volume when in the closed position; a primary support rod and a secondary support rod on each side of the support frame, wherein a first end of the primary support rod is attached to the primary storage unit via a bracket and a second end of the primary support rod is attached to a securing section of the support first frame, a first end of the secondary support rod is pivotally connected to the secondary storage unit via the bracket and a second end of the secondary support rod is connected to the support frame.

2. The combined storage system according to claim 1, wherein the connection between the primary storage unit and the support frame is a self-levelling connection.

3. The combined storage system according to claim 1, further comprising a telescopic lift aid, one end pivotally connected to the first frame, and the opposing end pivotally connected to the support frame.

4. The combined storage system according to claim 3, wherein the telescopic lift aid is a pneumatic piston.

5. The combined storage system according to claim 3, wherein the telescopic lift aid is a hydraulic piston.

6. The combined storage system according to claim 1, wherein the acute angle is between 40 and 80 degrees.

7. The combined storage system according to claim 1, wherein the first frame is a bed frame and the support frame is for supporting a mattress.

8. The combined storage system according to claim 1, wherein the primary storage unit comprises multiple units that occupy the first position in the closed position but are staggered in height when in the open position.

9. The combined storage system according to claim 1, wherein the acute angle is 30 degrees.

* * * * *